United States Patent [19]

Jenn et al.

[11] 4,071,739

[45] Jan. 31, 1978

[54] CONVERTIBLE RADIANT CONVECTION OVEN

[75] Inventors: Louis J. Jenn; Joseph J. Cerola, both of Indianapolis, Ind.

[73] Assignee: Jenn Air Corporation, Indianapolis, Ind.

[21] Appl. No.: 776,118

[22] Filed: Mar. 10, 1977

Related U.S. Application Data

[63] Continuation of Ser. No. 646,906, Jan. 6, 1976.

[51] Int. Cl.[2] ..... F27D 11/02

[52] U.S. Cl. ..... 219/400; 126/21 A; 99/447; 219/393; 219/408

[58] Field of Search ..... 99/340, 446, 447; 126/21 A, 198, 299 B; 219/393, 396, 398, 400, 408, 443, 476, 480

[56] References Cited

U.S. PATENT DOCUMENTS

| | | | |
|---|---|---|---|
| 2,862,095 | 11/1958 | Scofield | 219/400 UX |
| 3,089,479 | 5/1963 | Perl | 126/21 A |
| 3,587,555 | 6/1971 | Cerola | 219/393 |
| 3,678,245 | 7/1972 | Ackermann | 219/396 |
| 3,780,721 | 12/1973 | Durth | 126/21 A |
| 3,797,375 | 3/1974 | Cerola | 99/340 |
| 3,828,760 | 8/1974 | Farber et al. | 126/21 A |
| 3,884,213 | 5/1975 | Smith | 126/21 A |
| 3,889,100 | 6/1975 | Dills | 219/393 |
| 3,926,171 | 12/1975 | Kurck et al. | 126/21 A |
| 3,978,843 | 9/1976 | Durth | 219/400 X |

*Primary Examiner*—Volodymyr Y. Mayewsky
*Attorney, Agent, or Firm*—Woodard, Weikart, Emhardt & Naughton

[57] ABSTRACT

Disclosed is an oven which may or may not be incorporated in a domestic cooking range. The oven is characterized by the presence of a fan inset in one side wall of the oven. A plate having upper and lower slots approximately aligned with the conventionally located upper and lower oven heating elements overlies the fan. The slots or openings in the plate provide discharge apertures for the fan so that the air streams from the fan sweep past the heating elements to provide forced circulation or "convected" mode operation. Since the oven heating elements are conventionally located, the oven may be operated in the conventional, radiant mode by halting operation of the fan. The oven is thus easily convertible to either radiant or convection mode of operation.

4 Claims, 6 Drawing Figures

CONVERTIBLE RADIANT CONVECTION OVEN

CROSS-REFERENCE TO RELATED APPLICATION

This application is a continuation of our presently pending application Ser. No. 646,906 filed Jan. 6, 1976.

BACKGROUND OF THE INVENTION

Cooking ranges having ventilated surface units are well known in the prior art. One such range, with interchangeable surface elements, is discloded in, among others, Cerola U.S. Pat. No. 3,797,375. Radiant mode operated ovens, having gravity or forced ventilation, are disclosed in U.S. Pat. Nos. 2,862,095, 3,089,479 and 3,587,555. Convected, or forced circulation ovens are also well known, (U.S. Pat. Nos. 3,780,721, 3,838,760 and 3,884,213), these having the advantage of more efficient and rapid heat transfer to the food in preparation. This results in substantial energy saving and reduces meat shrinkage. To the present convected ovens have been used in institutional and commercial baking and have not been found in domestic ranges because of the long-established commitment to radiant type ovens and the design difficulty and customer resistance inherent in a change from the long-established raidant oven mode of operation. Since shorter cooking times are required for convection oven preparation of food, the required extrapolation from existing recipes (using radiant oven time requirements) has been a formidable barrier to widespread sales of convection type ovens to the domestic market.

The concept of the present invention envisages an oven which, because of the fan location and the location of its discharge apertures, can be operated, if desired, in the conventional radiant mode or in the convected mode and utilizes the conventional lower oven baking element and the conventional, upper broil element without requiring the addition of special heating elements for the convection mode operation of the oven.

DESCRIPTION OF THE PREFERRED EMBODIMENT

Figure 1:
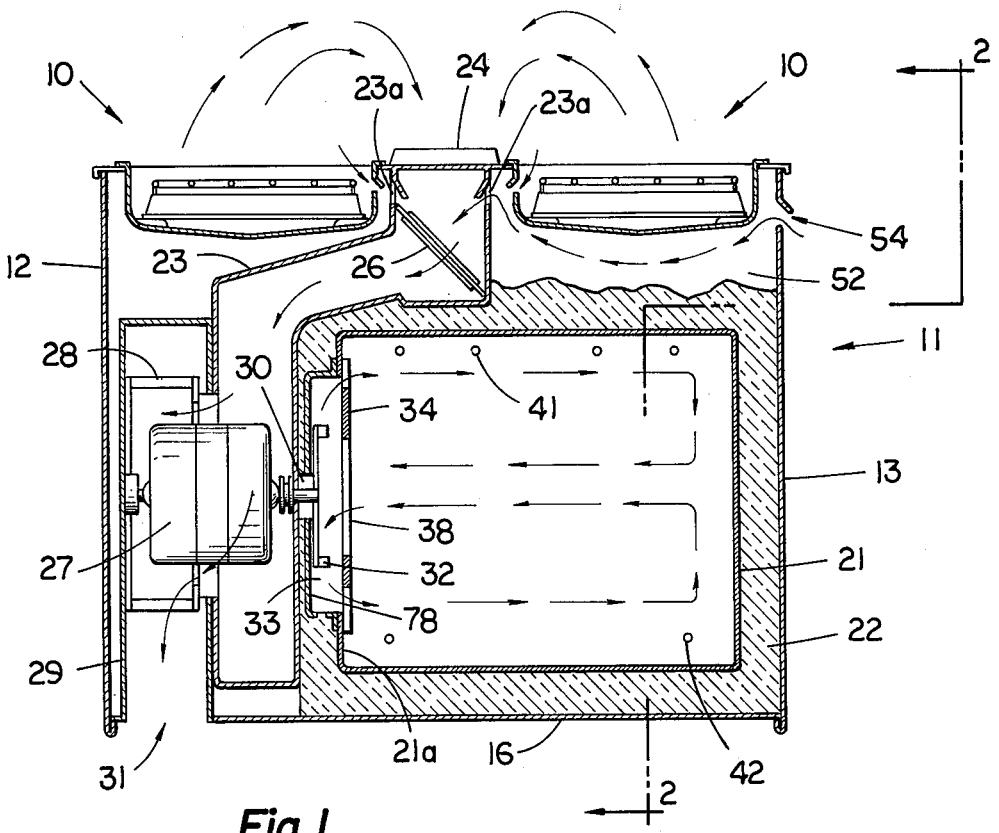
FIG. 1 is a side sectional view of a range embodying the present invention.
Figure 2:
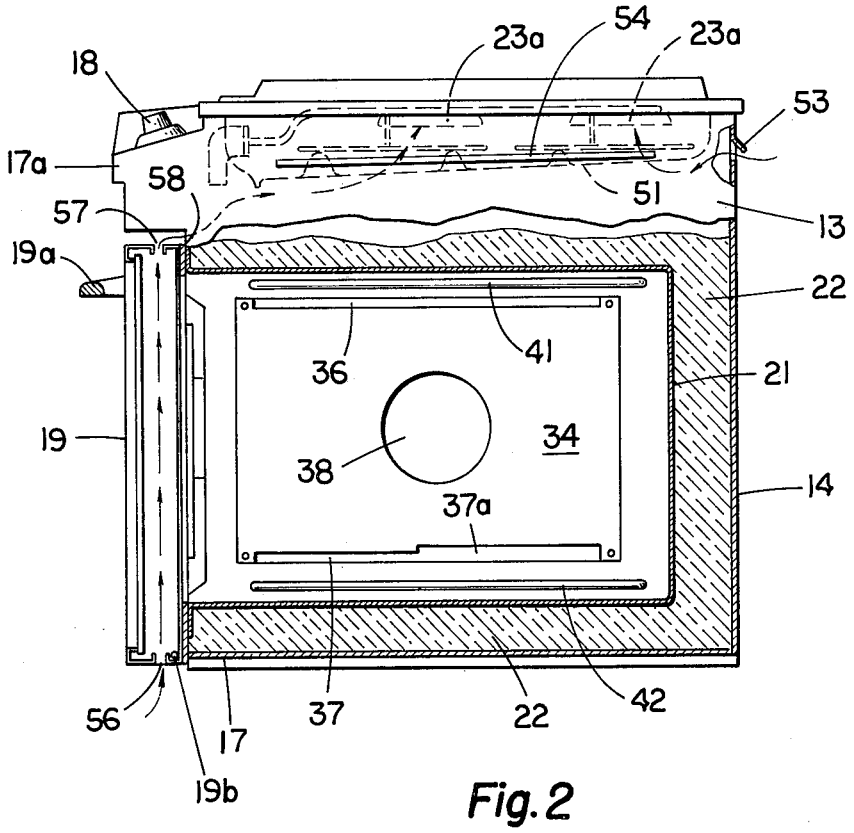
FIG. 2 is a side sectional view taken generally along the line 2—2 of FIG. 1.

Referring initially to FIGS. 1 and 2, the oven is shown incorporated into a ventilated range which includes a housing 11 accommodating upper top cooking elements identified generally at 10 and, underlying these, an isulated oven enclosure 21. The range housing 11 is formed by side panels 12 and 13, rear panels 14 (FIG. 2) and base 16. The oven enclosure is identified at 21 in FIG. 1 and is shown in detail in FIG. 3 as will subsequently be described. The front of the oven enclosure is open and is closed by the oven door 19, having a handle 19*a*. The oven door, as may be seen in FIG. 2, is hollow and is hinged along its base at 19*b* to the front panel, generally identified at 17 in FIG. 2, of the range. The front panel is formed to provide an overhang 17*a* which houses the conventional oven controls and controls for the upper elements 10. Extending generally along one sidewall 21*a* of the oven enclosure is a plenum structure 23. The plenum 23 extends over a portion of the upper wall of the oven enclosure and terminates at an inlet 24. A removable filter 26 may be disposed within the plenum. Mounted in the plenum and generally centered on the sidewall 21*a* of the oven enclosure is an electric motor 27 which drives a centrifugal wheel 28 disposed within the scroll or housing 29, the discharge of the centrifugal wheel being indicating at 31. It will be understood that this discharge or exhaust fitting may accommodate suitable flexible tubing which conveys the exhaust from the fan to the outside of the home or enclosure in which the range is located.

Figure 4:
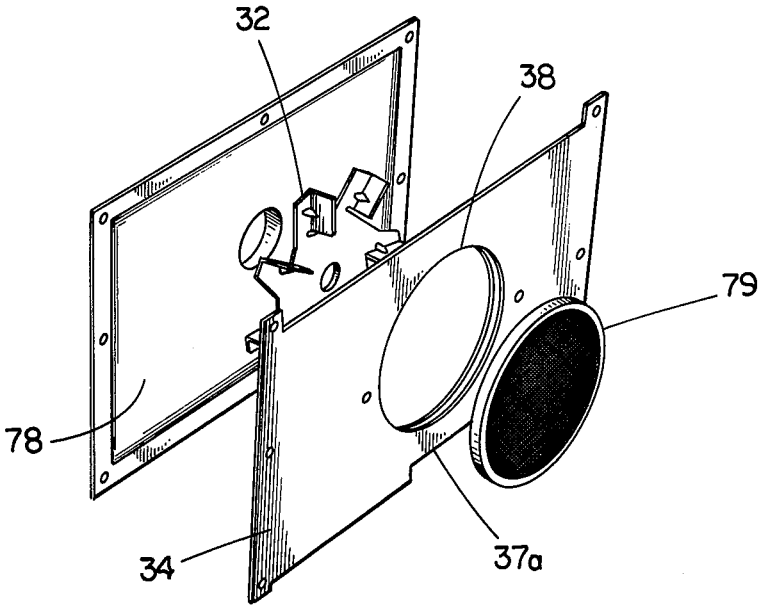
FIG. 4 is a perspective, exploded view of a further portion of an oven assembly of FIG. 3.

As may be seen in FIG. 1, the motor shaft, opposite its attachment to the centrifugal wheel 28, is extended through an opening 31 in the oven sidewall 31*a* and carries a centrifugal fan 32 which will subsequently be described in further detail with reference to FIG. 4. Inset in the insulation layer 22 is a dished plate 78 which provides a space 33 within which the fan 32 rotates, the plate 78 thus serving as a fan housing. The plate 34 forms the right hand (as viewed in FIG. 1) boundary of the space 33 and is provided with marginal upper and lower outlet slots 36 and 37 formed by cutting away a portion of the upper and lower marginal areas of the plate 34 as shown in detail in FIG. 4. As will be evident from FIGS. 2 and 4, the rear portion of the lower margin of the plate may be cut away somewhat more deeply as indicated at 37*a*. As will be evident from FIG. 1, these slots 36 and 37 form the discharge openings for the fan 32, the intake for the fan being formed by the central, circular opening 38 in the plate 34. As will subsequently be explained, the circulation of air within the oven caused by the operation of the fan 32 will sweep past the conventional upper or broil oven element 41 and the lower or baking element 42.

Figure 5:
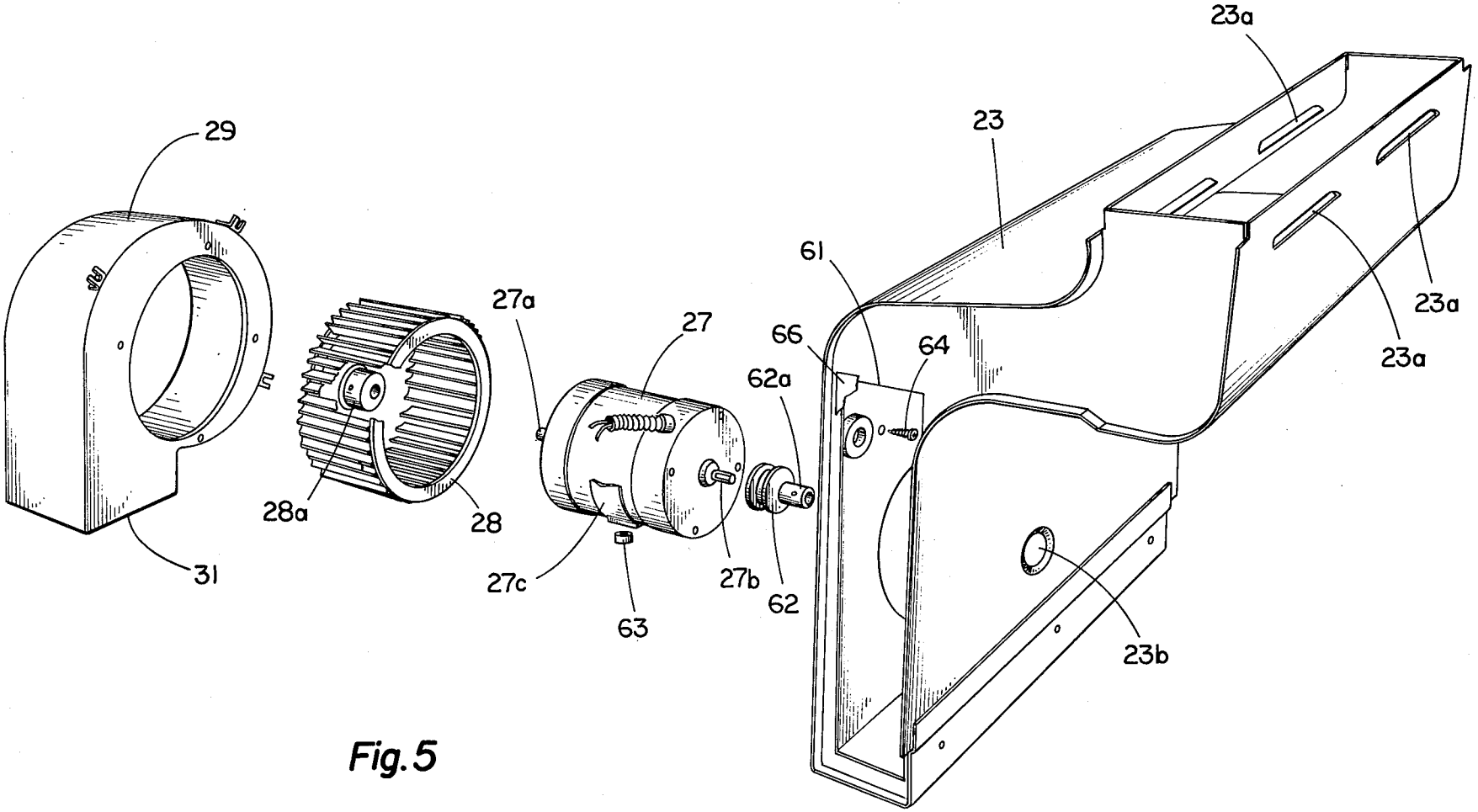
FIG. 5 is an exploded, perspective view of the plenum and cooperating air moving components of the structures shown in FIGS. 1 and 2.

Conventionally located within the oven at the upper end of the plenum 23 and adjacent its intake 24 there is provided a series of slots 23*a* which are shown in detail in FIG. 5. As may best be seen in FIG. 2, the burner box 51 which conventionally underlies the surface element 10 which is positioned above the oven 11 is spaced somewhat from the upper margin of the adjacent insulating layer 22 to form a passage 52. As may be seen in FIGS. 1 and 2, the rear wall 14 and the side wall 13 which are adjacent the oven enclosure 21 may be slotted as indicated at 53 and 54 to permit the entry of air from the exterior of the range into the passage 52 from whence it is drawn through the slots 23*a* into the plenum.

The oven door 19 is provided along its lower margin with a series of slots 56 and along its upper margin a series of slots 47. As previously mentioned, and as will be evident from FIG. 2, the interior of the door is hollow so that cooling air may enter the slot 56 and move upwardly to exit through the slots 57. This upward air flow through the door 19 is induced, not solely by convection, but by the sub-atmospheric pressure in the passage 52 caused by operation of the air moving means 28. Cooling air, exiting through the slots 57 in the door, is drawn through slots 58 which extend through the front panel 17 of the oven at the base of the overhang 17*a* as shown in FIG. 2. The slots 58 are closely adjacent the slots 57 when the door 19 is closed but are spaced somewhat therefrom and are in general registration or alignment with the slots 57.

Figure 6:
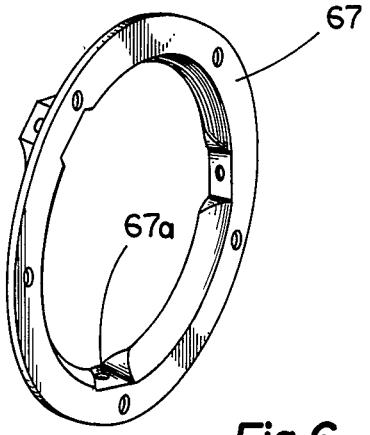
FIG. 6 is a perspective view of the motor mounting ring.

Referring to FIG. 5, it will be noted that the housing 29 of the blower wheel 28 is attached to the face of the member 23, forming the plenum, by means of bolts 61. The leftward extension (as viewed in FIG. 5) 27*a* of the motor shaft is received in the hub 28*a* of the blower wheel. The rightward extension 27*b* of the motor shaft receives a heat sink fitting 62, the extending shank of which, identified at 62*a* receives the hub of the centrifugal fan 32 of FIG. 4. The shank 62*a* of the fitting 62 extends through the aperture 23*b* in the sidewall of the plenum member 23, the fan 32 carried on the fitting being disposed within the adjacent enclosure formed in the oven sidewall as shown in FIG. 1. The motor 27 is mounted by means of a ring 27*c* and three spaced members 63, only a portion of the ring being shown in FIG. 5. A rectangular opening 64, providing access to the interior of the plenum, is normally closed by the removable cover plate 66, only a fragment of which is shown in FIG. 5. A mounting ring 67, as shown in FIG. 6 is received in the axial opening in the housing 29 and the three embossed portions 67*a* of the ring 67 (FIG. 6) accommodate the resilient spacers 63 and function to provide the three-point support for the motor 27, the spacers also providing air flow space around the motor.

Figure 3:
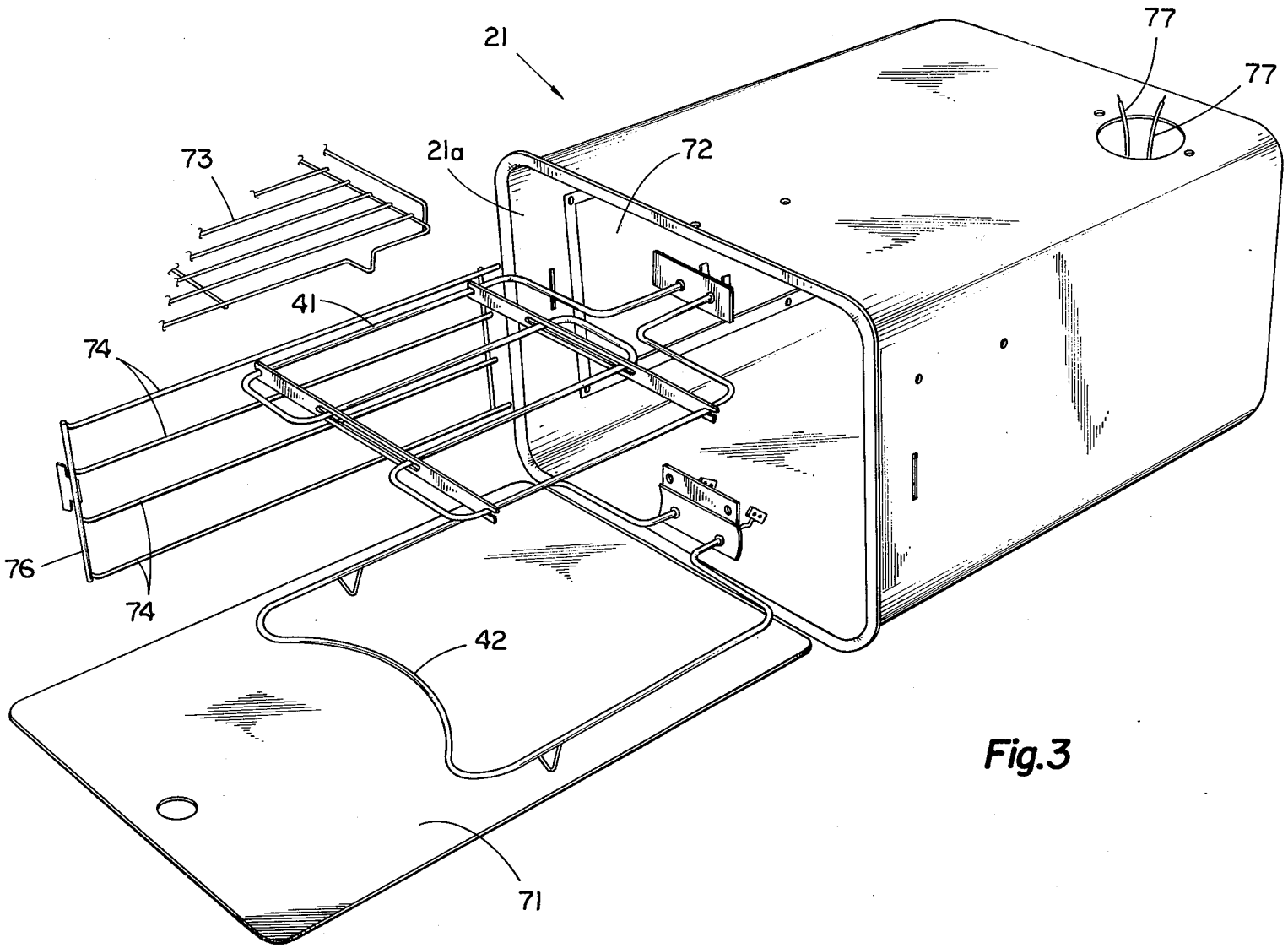
FIG. 3 is an exploded, perspective view of the oven component shown in FIG. 1.

Referring to FIG. 3, the oven is shown in further detail, The oven structure is composed of a generally rectangular box which receives in conventional fashion the upper or broil electrical heating element 41 which may be of the sheathed type, The conventional lower or baking heating element 42 is accommodated in the oven spaced slightly above the oven base. A drip tray 41 is slidable into and out of the oven and underlies the heating element 42. The wall 21*a* of the oven has a rectangular cutout portion 72. A conventional oven rack 73 may be inserted in the oven the rack being selectively positionable on the horizontal rails 74 of the side members 76, one of the members 76 being disposed on each side of the oven, only one, however, being shown in FIG. 3. Wire leads 77 by proper connection (not shown) serve to energize the conventional internal oven lamp (not shown).

It will be understood that the dished plate 78 (FIG. 4) overlies the opening 72 (FIG. 3) in the oven sidewall and, together with plate 34 (FIG. 4) forms the enclosed space 33 (FIG. 1) within which the fan 32 rotates. As may be seen in FIG. 4, the intake opening 38 in the plate 34 may be provided with a removable filter element 79.

In operation, the air moving means formed by the motor 27 and the blower 28 will draw fumes arising from food cooking on the surface elements into the intake 24 and will exhaust the fumes to the outside through the exhaust fitting 31 in conventional fashion. If the oven is to be utilized in the conventional mode, the motor 27 will not be energized and conventional baking may proceed utilizing the lower heating element 42 in the oven, or conventional radiant broiling may be accomplished by utilizing the upper oven heating element 41. The oven, in this radiant heating mode of operation may thus be utilized in conventional, domestic oven fashion.

If the oven is to be used in the convected mode, by proper setting of the control one or both of the elements 41 and 42 may be energized together with the air moving means embodied in motor 27 and the centrifugal fan 32. As may be seen in FIG. 1, with the fan 32 in operation the discharge of the fan will be channeled through the slots 36 and 37, with the current of air passing across and adjacent to the conventionally positioned upper and lower heating elements 41 and 42, the return path for the air moving through the opening 38 to the fan. As the air circulation arrows in FIG. 1 indicate, this provides a substantially closed circulation of air in the oven with the heated air impinging on the food in the oven and thus transferring heat from the elements 41 and 42 to the food by means of this forced circulation. This forced circulation heat transfer within the oven occurs without additional heating elements in the oven other than the conventional upper and lower units 41 and 42.

The convertibility of the oven of the present invention from radiant mode operation to the convected mode is one of the primary features of the oven structure described. This convertible operation is made possible by retaining conventionally placed upper and lower heating elements in the oven, placing the convection or circulating air-producing fan adjacent an oven wall and providing discharge apertures 36 and 37 for the fan at the level of both the upper and lower heating elements so that air moved by the fan sweeps past the heating elements, is heated by them, and then returns past the food in the oven to the fan intake aperture 38.

This convertability of the oven is more than a mere convenience. Domestic ranges have utilized radiant mode ovens for years, cookbooks and the skill of housewives in using these ovens are based on operation in the radiant mode. It will be understood that convection mode operation and forced circulation within an oven describes a different form of operation from that which occurs in a vented radiant oven. Conventional domestic radiant ovens are vented (not sealed), air moves into and out of the oven, either by gravity or is forced into movement as in the structures disclosed in U.S. Pats. Nos. 2,862,095 and 3,089,479. This vented-radiant mode of operation is not the convection mode of operation referred to herein in which the oven air is heated by the oven heating elements and acts as a heat transfer medium transferring heat from the elements to the food being baked or roased in the oven. Convection ovens have different time-temperature parameters from radiant ovens. Although convection mode operation ovens have certain advantages, including energy saving and, generally, less cooking time requirements, the substantial resistance by consumers to changeover to convection mode ovens, requiring recipe changes, has been a block to their widespread sale and use. Use of convection ovens in the domestic market, either built-in or in free-standing ranges, even with their advantages in energy saving, has been inhibited by domestic users' long acclimatization to radiant mode ovens. The convertible oven of the present invention, selectively operable in either mode, overcomes this consumer resistance to convection mode ovens. The domestic user of the oven can, over a period of time, accommodate food preparation procedures to the convection mode of oven operation, but can also, when desired, fall back on the accustomed radiant mode; and this can be done without acquiring a separate convection mode oven (such as disclosed in U.S. Pat. Nos. 3,828,760 and 3,780,721) in addition to the conventional range having a radiant mode oven.

While the invention has been illustrated and described in detail in the drawings and foregoing description, the same is to be considered as illustrative and not restrictive in character, it being understood that only the preferred embodiment have been shown and described and that all changes and modifications that come within the spirit of the invention are desired to be protected.

What is claimed is:

1. An oven operable in either a radiant mode or a convected mode and including an oven enclosure with conventional upper and lower heating elements therein, air moving means, a housing for said air moving means outside of said oven enclosure but disposed adjacent one wall thereof, said housing having an intake aperture and two discharge apertures communicating with the interior of the oven enclosure, one of said discharge apertures being located adjacent said upper oven heating element and the other adjacent said lower oven heating element, the location of said air moving means exteriorly of said oven enclosure and the placement of said discharge apertures adjacent said upper and lower heating elements permitting said oven to be selectively operated, when said heating elements are energized, in either the radiant mode when said air moving means is not in operation or in the convected mode when said air moving means is in operation.

2. An oven as claimed in claim 1 in which said air moving means includes a centrifugal fan disposed in said enclosure and a drive motor for said fan disposed exteriorly of said enclosure.

3. An oven as claimed in claim 1 in which one wall of said housing is a plate which also forms a portion of said one oven wall, and said discharge apertures comprise elongated slots in said plate.

4. An oven as claimed in claim 1 in which said discharge apertures comprise elongated slots in said one oven wall.

* * * * *